US005249943A

United States Patent [19]

Kuroki et al.

[11] Patent Number: 5,249,943

[45] Date of Patent: Oct. 5, 1993

[54] SCROLL TYPE COMPRESSOR HAVING RECESSED BUFFER MEANS IN A SPIRAL WRAP FLAT FACE

[75] Inventors: Kazuhiro Kuroki; Tetsuhiko Fukanuma; Tetsuo Yoshida; Tatsushi Mori, all of Kariya, Japan

[73] Assignee: Kabushiki Kaisha Toyoda Jidoshokki Seisakusho, Kariya, Japan

[21] Appl. No.: 901,997

[22] Filed: Jun. 22, 1992

[30] Foreign Application Priority Data

Jun. 27, 1991 [JP] Japan ..... 3-49461[U]

[51] Int. Cl.[5] ..... F04C 18/04

[52] U.S. Cl. ..... 418/55.2; 418/189

[58] Field of Search ..... 418/55.2, 189

[56] References Cited

U.S. PATENT DOCUMENTS 4,547,137 10/1985 Terauchi et al. ..... 418/55.2
4,781,549 11/1988 Caillat ..... 418/55.2

FOREIGN PATENT DOCUMENTS 0069531 1/1983 European Pat. Off. ..... 418/55.2
58-135393 8/1983 Japan ..... 418/55.2
59-58187 4/1984 Japan .
59-218380 12/1984 Japan .
62-107283 5/1987 Japan ..... 418/55.2

*Primary Examiner*—John J. Vrablik
*Attorney, Agent, or Firm*—Brooks Haidt Haffner & Delahunty

[57] ABSTRACT

A scroll type compressor which includes a fixed scroll and an orbiting scroll. Each scroll includes an end plate, a spiral element, at least one airtight compression chamber formed between the fixed and orbiting scrolls, a discharge port, and a drive mechanism for revolving the orbiting scroll relative to the fixed scroll, for compressing fluid in the compression chamber. The fixed spiral element and the orbiting spiral element include relatively thick tip portions having oppositely disposed flat faces. These faces are arranged in such a way as to periodically approach each other during the revolution of the orbiting scroll. A buffer portion is provided on at least one of the flat faces of the fixed and orbiting tip portions, for preventing over-compression of the fluid trapped between the flat faces.

5 Claims, 5 Drawing Sheets

SCROLL TYPE COMPRESSOR HAVING RECESSED BUFFER MEANS IN A SPIRAL WRAP FLAT FACE

BACKGROUND OF THE INVENTION

1. Field of the Invention

The present invention relates to a scroll type compressor provided with a fixed scroll, an orbiting scroll revolvable around the fixed scroll, and compression chambers defined between the fixed scroll and orbiting scroll, such that the volumes of the compression chambers are reduced in accordance with the revolution of the orbiting scroll.

2. Description of the Related Art

Japanese Unexamined Patent Publication No. 59-58187 (corresponding to U.S. Pat. No. 4,547,137) discloses a scroll type compressor in which the central tip portions of spiral elements of a fixed scroll and an orbiting scroll are formed thicker in order to improve the durability of the central tip portions and reduce the size and weight of the overall compressor.

This conventional compressor will be described in more detail. The inner wall and outer wall of each of the spiral elements of the scrolls are formed along involute curves. The starting points of the involute curves of the inner and outer walls are separated by 180°. Further, the central tip portions have flat inner walls facing each other, which are formed along a line which linearly connects both starting points. The central tip portion of each scroll is approximately semicircular, and is relatively thicker than in previous scroll type compressors. This design improves the mechanical strength of the central tip portion of each spiral element.

In the conventional scroll type compressor, the flat inner walls of the central tip portions of both scrolls come into close contact with each other. The discharge port provided in the center of the fixed scroll is covered by the tip portion of the orbiting scroll at the final compression stage. The close contact of both inner walls prevents the compressed gas from escaping, thus creating an over-compressed state between both inner walls. This over-compression causes an excessive compressive stress which may damage the central tip portions of the scrolls.

SUMMARY OF THE INVENTION

Accordingly, it is a primary objective of the present invention to provide a scroll type compressor which is designed to prevent the walls of the scrolls from being damaged by over-compression of gas, and which has excellent durability.

To achieve the foregoing and other objects and in accordance with the purpose of the present invention, an improved scroll type compressor is provided. This compressor comprises a fixed scroll having a fixed end plate and a fixed spiral element. An orbiting scroll has an orbiting end plate and an orbiting spiral element. A plurality of airtight compression chambers are formed between the fixed and orbiting scrolls. A discharge port discharges fluid from the compression chamber. A drive mechanism causes the orbiting scroll to revolve relative to the fixed scroll, in order to compress the fluid in the compression chamber.

The fixed spiral element has a thick fixed tip portion with a flat face on the inner wall side. The orbiting spiral element has a thick orbiting tip portion with a flat face facing the flat face of the fixed tip portion. The orbiting scroll is mounted in such a way as to revolve relative to the fixed scroll with the fixed and orbiting spiral elements interleaved so that the flat faces of the fixed and orbiting tip portions periodically approach each other during the revolution of the orbiting scroll. A buffer portion is provided on at least one of the flat faces of the fixed and orbiting tip portions for preventing over-compression of the fluid trapped between the adjacent flat faces.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

One preferred embodiment of the present invention as embodied in an air conditioner for a vehicle will now be described referring to FIGS. 1 through 6.

Figure 1:
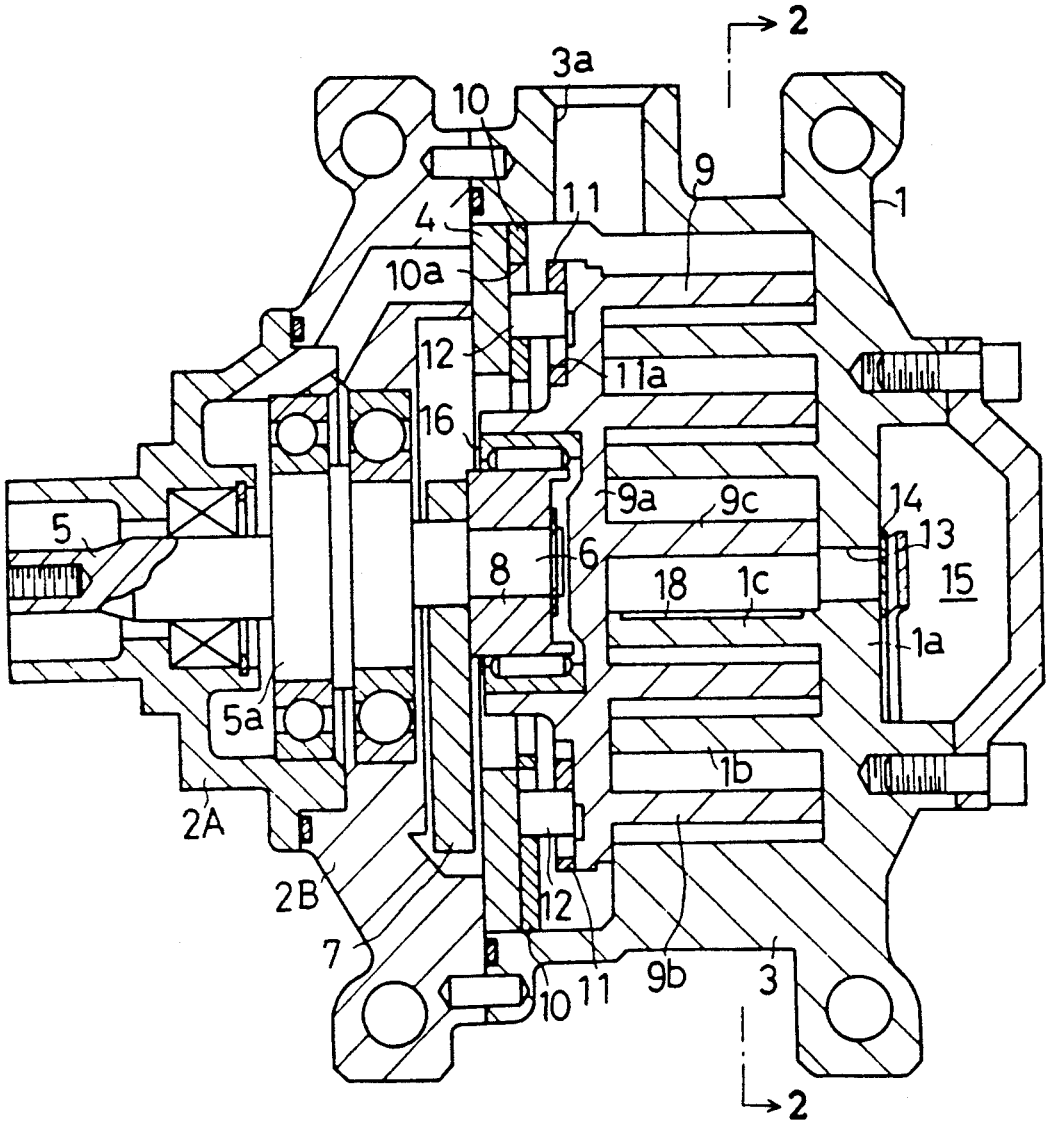
FIG. 1 is a side cross sectional view of a scroll type compressor according to one embodiment of the present invention.

As shown in FIG. 1, a scroll type compressor comprises a fixed scroll 1 formed integral with a rear housing and front housings 2A and 2B connected to the fixed scroll 1. A circular base plate 4 is securely fitted in the inner side of the tip portion of an outer wall 3 of the fixed scroll 1 in such a way as to contact the front face of the front housing 2B.

A drive shaft 5 having an enlarged portion 5*a* is housed rotatably within the front housings 2A and 2B. A pin 6 which is eccentric to the axis of the drive shaft 5 protrudes from the inner end portion of the enlarged portion 5*a*. The eccentric pin 6 passes through the central opening portion of the base plate 4, and is inserted within the fixed scroll 1.

A counterweight 7 includes an arched plate supported by the eccentric pin 6, and a bushing 8 is rotatably supported by the eccentric pin 6. Further, the orbiting scroll 9 is supported rotatably by the bushing 8, via a radial bearing 16.

Figure 2:
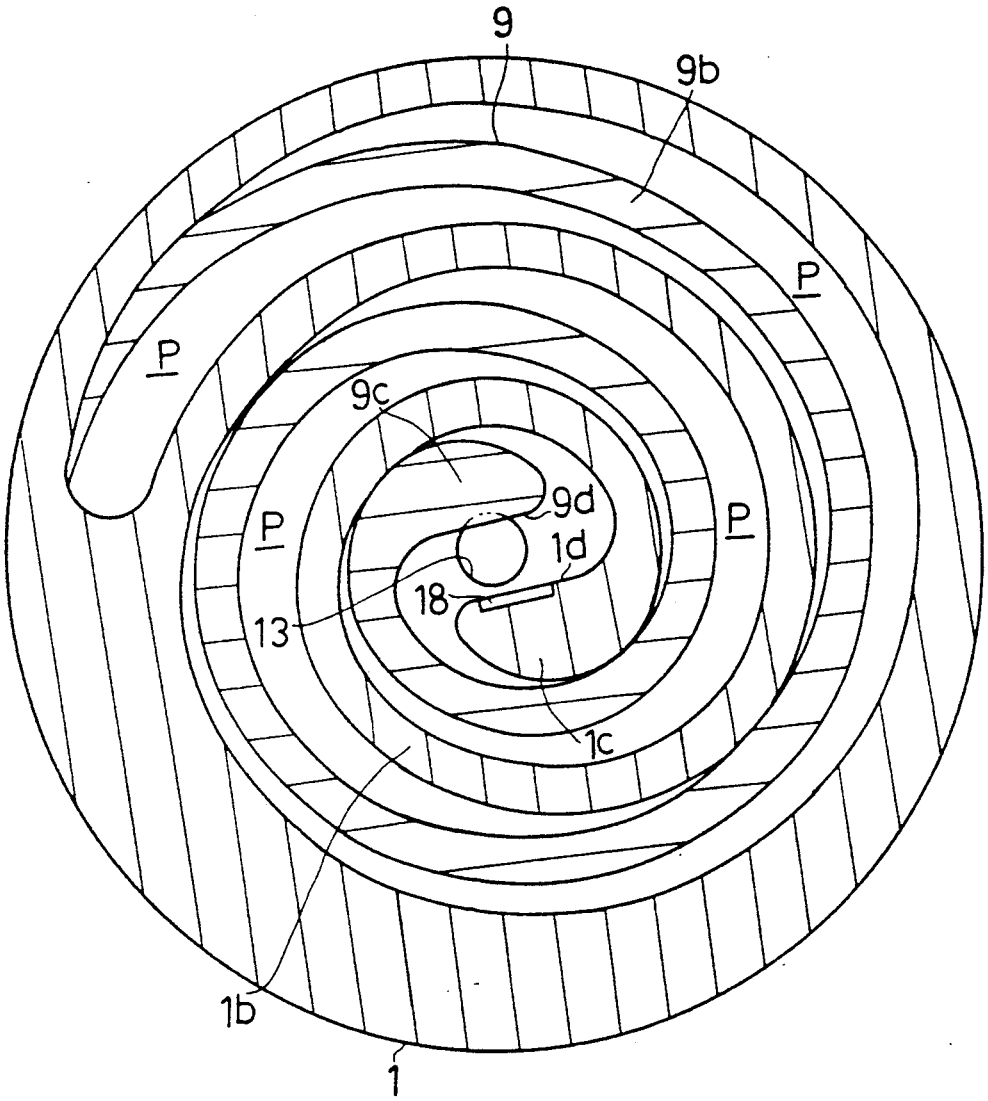
FIG. 2 is an enlarged cross sectional view taken along line 2—2 in FIG. 1.

As shown in FIGS. 1 and 2, the orbiting scroll 9 is disposed in the fixed scroll 1. The fixed scroll 1 has an end plate 1*a* and a spiral element 1*b* protrusively provided on one side of the end plate 1*a*. Likewise, the orbiting scroll has an end plate 9*a* and a spiral element 9*b* provided on the side of the end plate 9*a* which faces the fixed end plate 1*a*. As the fixed scroll 1 and the orbiting scroll 9 are connected to each other, a plurality of compression chambers P are formed between the end plates 1*a* and 9*a* and the spiral elements 1*b* and 9*b*.

A fixed ring 10 is secured on the surface of the base plate 4 which faces the orbiting scroll 9, as shown in FIG. 1. The fixed ring 10 has a plurality of circular positioning holes 10*a* bored therein at equal intervals. An orbiting ring 11 is secured to the back of the end plate 9*a* of the orbiting scroll 9. The orbiting ring 11 likewise has a plurality of circular positioning holes 11*a* bored therein at equal intervals. The positioning holes 11*a* correspond to the positioning holes 10*a* of the fixed ring 10.

A cylindrical transmission shoe 12 is located between every corresponding positioning holes 10*a* and 11*a*. Each pair of positioning holes 10*a* and 11*a* form a circular region where the associated transmission shoe 12 can move. The movable diameter of each transmission shoe 12 is set in such a way as to match the revolution radius of the eccentric pin 6 around the drive shaft 5. Since all the transmission shoes 12 rotate in the same direction along the inner walls of the positioning holes 10*a* and 11*a*, with the revolution of the eccentric pin 6, the orbiting scroll 9 revolves around the axis of the fixed scroll 1 without rotating.

Figure 3:
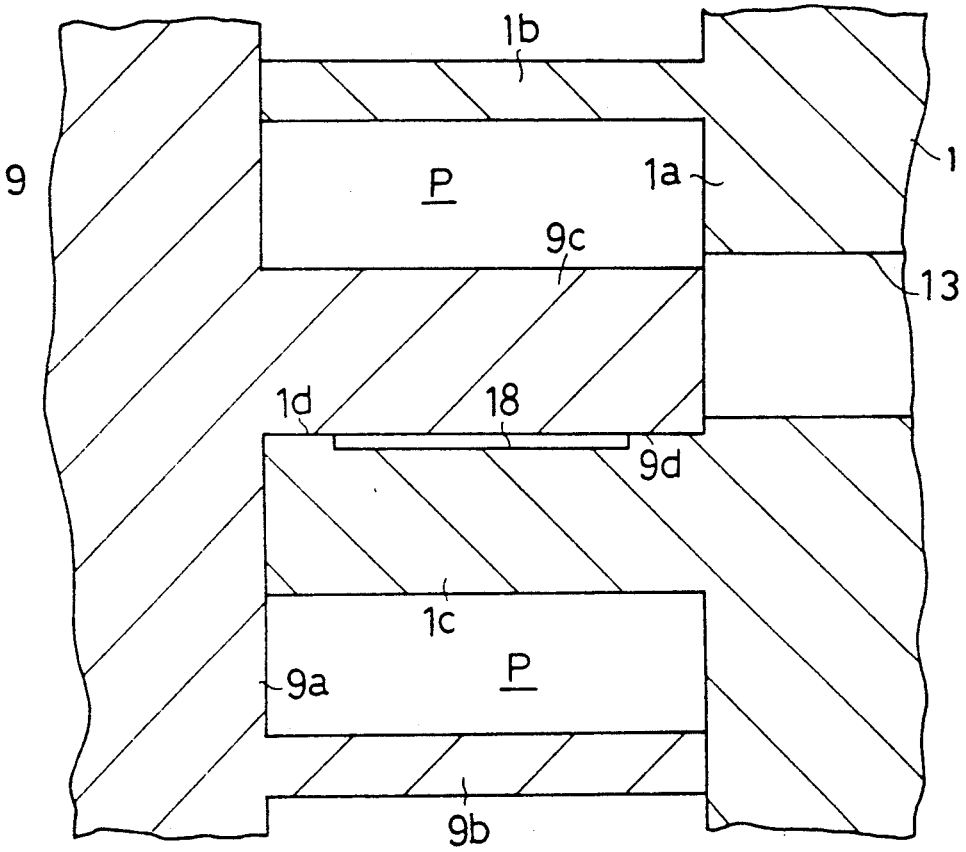
FIG. 3 is a greatly enlarged cross-sectional view illustrating that the flat faces of the central tip portions of the fixed and orbiting scrolls come into close contact with each other.

As shown in FIGS. 2 and 3, the spiral element 1*b* of the fixed scroll 1 has a central tip portion 1*c* which is thicker than the other portion. A flat face 1*d* is formed on the inner wall of the central tip portion 1*c* rather than along an involute curve. Likewise, the spiral element 9*b* of the orbiting scroll 9 has a central tip portion 9*c* which is thicker than the other portion. A flat face 9*d* is formed, on the inner wall of the central tip portion 9*c* rather than along an involute curve.

The flat face 1*d* of the fixed scroll 1 is located opposite the flat face 9*d* of the orbiting scroll 9. Both flat faces 1*d* and 9*d* periodically approach each other, and thereafter move away from each other, with the revolution of the orbiting scroll 9. In the present embodiment, a groove-like buffer recess 18 is formed in the flat face 1*d* of the fixed scroll 1.

An inlet port 3*a* is provided on the outer wall 3 of the fixed scroll 1, to allow the refrigerant gas to enter the fixed scroll 1. A discharge port 13 is formed through the center of the end plate 1*a* of the fixed scroll 1. A discharge chamber 15, which communicates with the outside, is provided on the backside of the fixed end plate 1*a*. The discharge chamber 15 communicates with the discharge port 13 or disconnected therefrom by an openable and closable discharge valve 14.

The operation of the present compressor will now be discussed. The refrigerant gas entering through the inlet port 3*a* is led into the compression chambers P defined by the scrolls 1 and 9. As the orbiting scroll 9 revolves, the compression chambers P decrease their volumes while gradually moving toward the central tip portions 1*c* and 9*c* of the spiral elements 1*b* and 9*b*. This gradually compresses the refrigerant gas in each compression chamber P.

Figure 4:
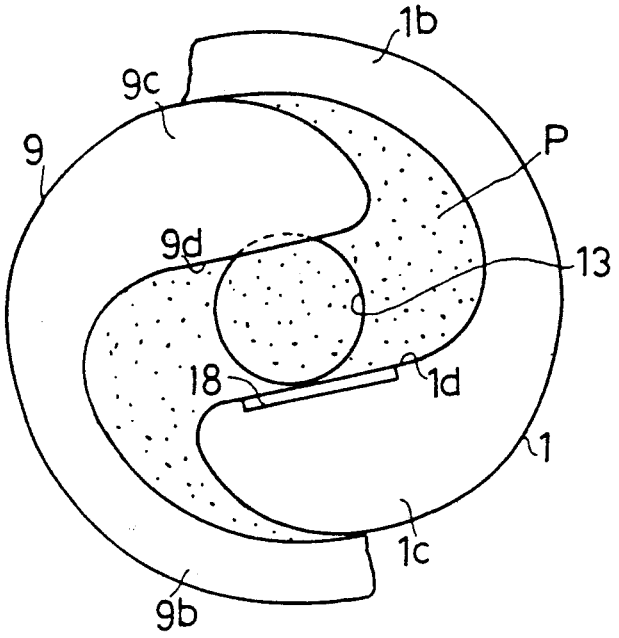
FIGS. 4, 5 and 6 are sequential diagrams for explaining the gas compressing state in the vicinity of a discharge port.
Figure 5:
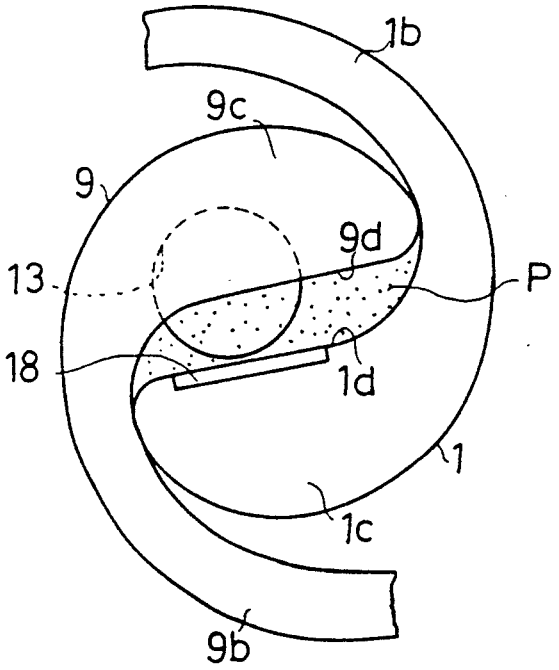
Figure 6:
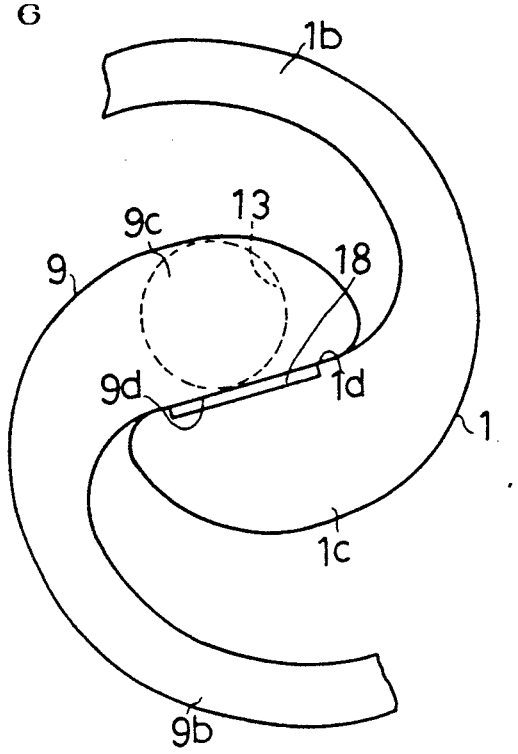

When the compression chamber P reaches the position surrounded by the central tip portions 1*c* and 9*c* of the scrolls 1 and 9, the compressed refrigerant gas flows into the discharge port 13 and simultaneously causes the discharge valve to open under the action of the gas pressure, as shown in FIG. 4. The compressed gas is then discharged into the discharge chamber 15 in accordance with the reduction of the volumes of each compression chamber P, as shown in FIG. 5. When the flat faces 1*d* and 9*d* of the scrolls 1 and 9 come into close contact with each other, the volume of the compression chamber P becomes nearly zero, as shown in FIG. 6. At this time, the discharge port 13 is covered almost completely with the central tip portion 9*c* of the orbiting scroll 9. Consequently, the space surrounded by the scrolls 1 and 9 is completely disconnected from the discharge port 13.

According to the conventional scroll type compressor which does not have the buffer recess 18 of this embodiment, the remaining refrigerant gas cannot escape anywhere in the state shown in FIG. 6 and is thus over-compressed between the flat faces 1*d* and 9*d* that closely contact each other. Although the central tip portions 1*c* and 9*c* of the scrolls 1 and 9 are formed relatively thicker, the central tip portions 1*c* and 9*c* are likely to be damaged by the excess compressive stress.

Since the present buffer recess 18 is provided on the flat face 1*d*, the remaining refrigerant gas can escape into the buffer recess 18 even in the state shown in FIG. 6, thus avoiding an over-compressed state. Therefore, the central tip portions 1*c* and 9*c* will not be subjected to a large compressive stress and will not be prematurely damaged. In addition, the driving torque of the drive shaft 5 can be smaller than that in conventional scroll type compressors.

Although only one embodiment of the present invention has been described herein, it should be apparent to those skilled in the art that the present invention may be embodied in many other specific forms without departing from the spirit or scope of the invention.

Figure 7:
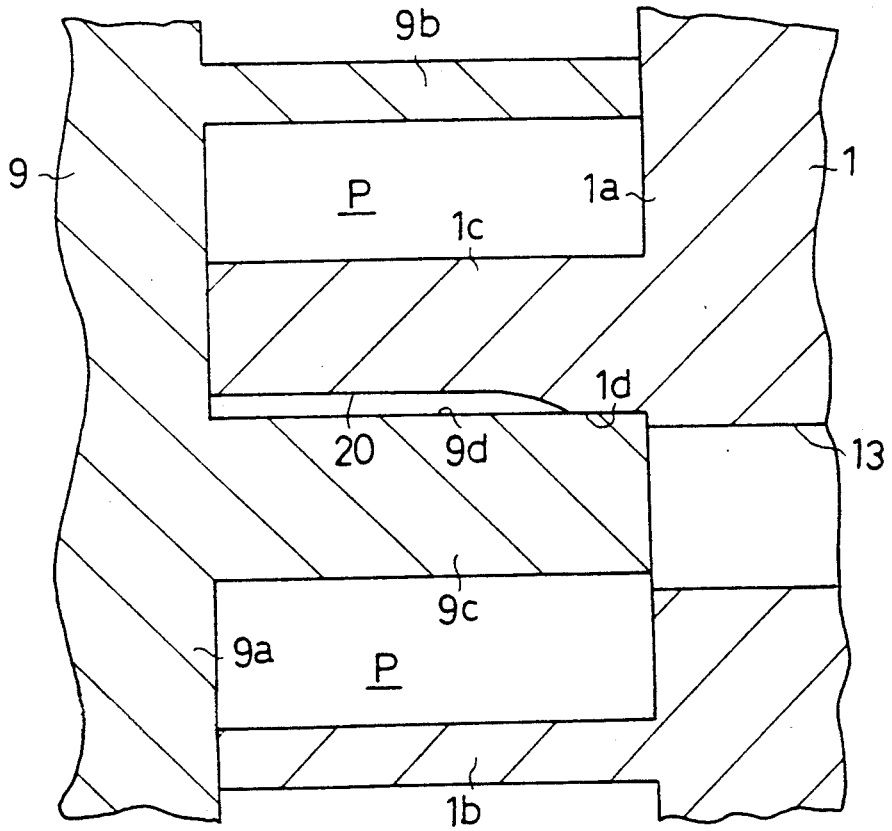
FIG. 7 is a greatly enlarged cross sectional view of another embodiment of the present invention, which corresponds to FIG. 3.

Particularly, it should be understood that, as shown in FIG. 7, a buffer recess 20 is formed on the flat face 1*d* of the central tip portion 1*c* of the fixed scroll 1. The buffer recess 20 extends to the tip of the flat face 1*d* from a position located at a distance from the end plate 1*a*. As the buffer recess 20 does not reach the end plate 1*a* of the fixed scroll 1, the recess does not harm the durability of the central tip portion 1*c* and the end plate 1*a*.

Further, the buffer recesses shown in FIGS. 3 and 7 may be provided on the orbiting scroll 9, rather than on the fixed scroll 1. Alternatively, such the buffer recesses may be provided on both scrolls 1 and 9.

Therefore, the present embodiments are to be considered as illustrative and not restrictive, and the invention is not to be limited to the details given herein, but may be modified within the scope of the appended claims.

What is claimed is:

1. A scroll type compressor comprising:

a fixed scroll including a fixed end plate and a fixed spiral element bounded by radially inner and outer walls joined to said fixed end plate perpendicularly thereto and extending longitudinally along a spiral path terminating in an inner radially widened fixed tip portion, said fixed tip portion on said inner wall having a flat face;

an orbiting scroll including an orbiting end plate and an orbiting spiral element joined to said orbiting end plate perpendicularly thereto and extending longitudinally along a spiral path terminating in an inner radially widened orbiting tip portion, said orbiting tip portion having a radially inner wall with an orbiting flat face disposed to face said fixed tip flat face;

said orbiting scroll being mounted for orbital revolving movement relative to said fixed scroll with said fixed and orbiting spiral elements interleaved such that said flat faces of said fixed and orbiting tip portions periodically approach each other during revolution of said orbiting scroll;

at least one airtight compression chamber formed between said fixed scroll and said orbiting scroll;

a discharge port formed in said fixed end plate for discharging fluid from said compression chamber, said discharge port being located in said fixed end plate where said port is covered completely by said orbiting tip portion of said orbiting scroll during the end of the compression cycle when said flat faces of said fixed and orbiting tip portions are in close proximity to each other;

drive means for revolving said orbiting scroll relative to said fixed scroll for reducing the volume of said compression chamber to compress the fluid in said compression chamber; and buffer means in the form of a recess in at least one of said flat faces of said fixed and orbiting tip portions for forming an airtight cavity which is isolated from said discharge port during the end of the compression cycle;

said airtight cavity providing a space for preventing over compression of the compressed fluid which is trapped between said flat faces of adjacent fixed and orbiting tip portions.

2. The scroll type compressor according to claim 1, wherein said recess is formed in said fixed tip portion.

3. The scroll type compressor according to claim 2, wherein said flat face of said orbiting scroll engages said flat face of said fixed scroll to substantially seal said recess therein.

4. The scroll type compressor according to claim 1, wherein said recess is formed in said fixed tip portion and extends from the top of said flat face to a position located at a predetermined distance from said fixed end plate.

5. The scroll type compressor according to claim 1, wherein said flat faces of said fixed and orbiting tip portions are substantially parallel to each other at least during the end of the compression cycle.

* * * * *